US011041674B2

(12) United States Patent
Nystuen et al.

(10) Patent No.: US 11,041,674 B2
(45) Date of Patent: Jun. 22, 2021

(54) MATERIAL AGITATOR

(71) Applicant: Intelligent Malt, LLC, Fargo, ND (US)

(72) Inventors: Paul Nystuen, West Fargo, ND (US); Adam Nystuen, Barnesville, MN (US); Tyler Peterson, Dubuque, IA (US)

(73) Assignee: Intelligent Malt, LLC, Fargo, ND (US)

( * ) Notice: Subject to any disclaimer, the term of this patent is extended or adjusted under 35 U.S.C. 154(b) by 161 days.

(21) Appl. No.: 15/687,467

(22) Filed: Aug. 26, 2017

(65) Prior Publication Data

US 2019/0063837 A1 Feb. 28, 2019

(51) Int. Cl.

| | |
|---|---|
| ***F26B 25/04*** | (2006.01) |
| ***F26B 3/092*** | (2006.01) |
| ***F26B 17/00*** | (2006.01) |
| ***F26B 9/08*** | (2006.01) |
| ***F26B 9/06*** | (2006.01) |
| *F26B 11/06* | (2006.01) |
| *F26B 13/12* | (2006.01) |

(52) U.S. Cl.

CPC ..... *F26B 25/04* (2013.01); *F26B 3/0923* (2013.01); *F26B 9/063* (2013.01); *F26B 9/082* (2013.01); *F26B 17/002* (2013.01); *F26B 11/0486* (2013.01); *F26B 13/12* (2013.01); *F26B 2200/06* (2013.01)

(58) Field of Classification Search

CPC ..... B01F 7/00558; B01F 7/0005; B01F 7/00066; B01F 7/00158; B01F 7/00283; F26B 25/04; F26B 3/0923; F26B 9/063; F26B 9/082; F26B 11/0486; F26B 2200/06

USPC ..... 366/261

See application file for complete search history.

(56) References Cited

U.S. PATENT DOCUMENTS

| | | | | | |
|---|---|---|---|---|---|
| 1,361,870 | A * | 12/1920 | Kiddie | B01F 7/00558 | 366/64 |
| 1,419,737 | A * | 6/1922 | Kiddie | B01F 7/00558 | 366/67 |
| 1,540,547 | A * | 6/1925 | Doidge | B01F 7/00558 | 366/46 |
| 5,057,284 | A * | 10/1991 | Emmett, Jr. | B01F 3/04269 | 422/225 |
| 5,637,336 | A | 6/1997 | Kannenberg et al. | | |
| 6,712,499 | B2 * | 3/2004 | Fink, Jr. | B01F 7/18 | 366/325.5 |

(Continued)

FOREIGN PATENT DOCUMENTS

| | | | | |
|---|---|---|---|---|
| DE | 1919477 | A1 | 8/1970 | |
| DE | 102011111273 | A1 | 2/2013 | |
| FR | 497084 | A * | 11/1919 | B01F 7/00558 |

OTHER PUBLICATIONS

Machine translation of DE1919477A1, retrieved Oct. 10, 2017, 5 pgs.

(Continued)

*Primary Examiner* — Marc C Howell

(74) *Attorney, Agent, or Firm* — Danielson Legal LLC

(57) ABSTRACT

Methods and devices for agitating material. In some embodiments, an agitator is positioned in a receptacle to agitate material therein. The agitator may include a shaft, an arm extending from the shaft, and at least one knife extending from the arm. In some embodiments, the agitator may further include one or more agitator elements operably connected to at least one knife.

22 Claims, 8 Drawing Sheets

(56) References Cited

U.S. PATENT DOCUMENTS

| | | | | |
|---|---|---|---|---|
| 7,128,462 | B2 * | 10/2006 | Swisher | B01F 7/001 366/47 |
| 2015/0290607 | A1 * | 10/2015 | Tolle | B01F 7/00133 366/199 |
| 2016/0250607 | A1 * | 9/2016 | Easton | B02C 23/18 106/638 |

OTHER PUBLICATIONS

Machine translation of DE102011111273A1 retrieved Oct. 9, 2017, 16 pgs.

* cited by examiner

MATERIAL AGITATOR

TECHNICAL FIELD

Embodiments described herein generally relate to methods and devices for agitating material.

BACKGROUND

Malting is a method of turning granular material such as cereal grains into malt. Malting generally begins once a particular material is in a receptacle and has been submerged in water for a predetermined amount of time. This step is known as steeping.

After steeping, the material is moved to a different receptacle for germination and kilning. In this step the material begins to grow and is dried. During the germination stage, it is important that the material is agitated (i.e., stirred) in order to avoid heating or matting. If a batch mats, it will spoil and become unusable.

Existing techniques for agitating material generally involve using vertical augers. Vertical augers are traditionally suspended from a gantry and move slowly back and forth in a receptacle holding a particular material. The back-and-forth motion of the auger agitates the material.

Vertical augers, however, often do not allow for much flexibility in operation. For example, if the auger flight is fixed and the gantry speed and rotational speed are set, the auger may be unable to accommodate different types of material or different operational requirements.

A need exists, therefore, for agitator devices and methods that overcome the above disadvantages of existing devices and methods.

SUMMARY

This summary is provided to introduce a selection of concepts in a simplified form that are further described below in the Detailed Description section. This summary is not intended to identify or exclude key features or essential features of the claimed subject matter, nor is it intended to be used as an aid in determining the scope of the claimed subject matter.

In one aspect, embodiments relate to an agitator. The agitator includes a shaft, an arm extending substantially orthogonally from the shaft, and at least one knife per arm extending substantially orthogonally from the arm.

In some embodiments, the agitator further includes at least one agitator element extending between two knives. In some embodiments, each of the two knives include a plurality of apertures configured to receive the at least one agitator element. In some embodiments, the agitator further includes at least one horizontal support placed between the two knives and attached to each knife. In some embodiments, the placement of the at least one agitator element is adjustable. In some embodiments, the tension on each of the at least one agitator element is individually adjustable.

In some embodiments the agitator further includes at least one agitator element extending between the shaft and a knife.

In some embodiments, the agitator further includes a movement mechanism rotatably coupled to the shaft. In some embodiments, the at least one knife is affixed to the arm.

In some embodiments, the arm includes a proximal end and a distal end, the distal end having an additional knife hanging therefrom that has at least one side rake secured thereon. In some embodiments, the side rake includes at least one of a vertical hanging wire and at least one flexible pad.

In some embodiments, the agitator further includes a bottom rake horizontally attached to the at least one knife. In some embodiments, the bottom rake includes at least one rigid pad and at least one flexible pad.

In some embodiments, the agitator is operably positioned in a receptacle.

In some embodiments, the agitator further includes at least a second arm extending substantially orthogonally from the shaft, and at least one knife extending substantially orthogonally from the second arm.

In some embodiments, the agitator further includes at least one delta blade affixed to the at least one knife.

In some embodiments, the agitator further includes a chain extending from a first knife to a second knife or from a first knife to the shaft.

In some embodiments, the agitator further includes a cable extending from a first knife to a second knife or from a first knife to the shaft.

In some embodiments, the agitator further includes a rigid material extending from a first knife to a second knife or from a first knife to the shaft.

According to another aspect, embodiments relate to a method of agitating receptacle content. The method includes operably positioning the agitator described above in a receptacle, filling the receptacle with a granular material, and rotating the shaft of the agitator.

In some embodiments, the agitator described above further includes at least one agitator element extending between two knives. In some embodiments, the method further includes adjusting the tension on the at least one agitator element.

According to yet another aspect, embodiments relate to an agitator. The agitator includes a vertical shaft; an arm extending substantially horizontally from the vertical shaft; at least one knife extending substantially orthogonally from the arm; and at least one agitator element extending from the at least one knife.

BRIEF DESCRIPTION OF DRAWINGS

Non-limiting and non-exhaustive embodiments of the invention are described with reference to the following figures, wherein like reference numerals refer to like parts throughout the various views unless otherwise specified.

DETAILED DESCRIPTION

Various embodiments are described more fully below with reference to the accompanying drawings, which form a part hereof, and which show specific exemplary embodiments. However, the concepts of the present disclosure may be implemented in many different forms and should not be construed as limited to the embodiments set forth herein; rather, these embodiments are provided as part of a thorough and complete disclosure, to fully convey the scope of the concepts, techniques and implementations of the present disclosure to those skilled in the art. Embodiments may be practiced as methods, systems or devices. Accordingly, embodiments may take the form of a hardware implementation, an entirely software implementation or an implementation combining software and hardware aspects. The following detailed description is, therefore, not to be taken in a limiting sense.

Reference in the specification to "one embodiment" or to "an embodiment" means that a particular feature, structure, or characteristic described in connection with the embodiments is included in at least one example implementation or technique in accordance with the present disclosure. The appearances of the phrase "in one embodiment" in various places in the specification are not necessarily all referring to the same embodiment.

In addition, the language used in the specification has been principally selected for readability and instructional purposes and may not have been selected to delineate or circumscribe the disclosed subject matter. Accordingly, the present disclosure is intended to be illustrative, and not limiting, of the scope of the concepts discussed herein.

Embodiments described herein are directed towards an agitator used in processes such as malting a granular material. In some embodiments, the agitator may be implemented in mid-sized, stacked, modulator malting facilities.

In some embodiments, the agitator may include a shaft, at least one arm extending from the shaft, and one or more knives hanging or otherwise extending downward from the arm. In some of these embodiments, the shaft may be positioned vertically in a receptacle containing a granular material. The agitator may further include at least one agitator element extending between the knives, as well as a bottom and/or a side rake to prevent matting along the floor and sides of the receptacle, respectively.

The agitator of various embodiments described herein overcomes the disadvantages of existing agitation devices and techniques. For one, the agitator described herein can operate in receptacles with shallow beds. Additionally, the agitator described herein can be adjusted to accommodate different types of material and for different types of processes.

Figure 1:
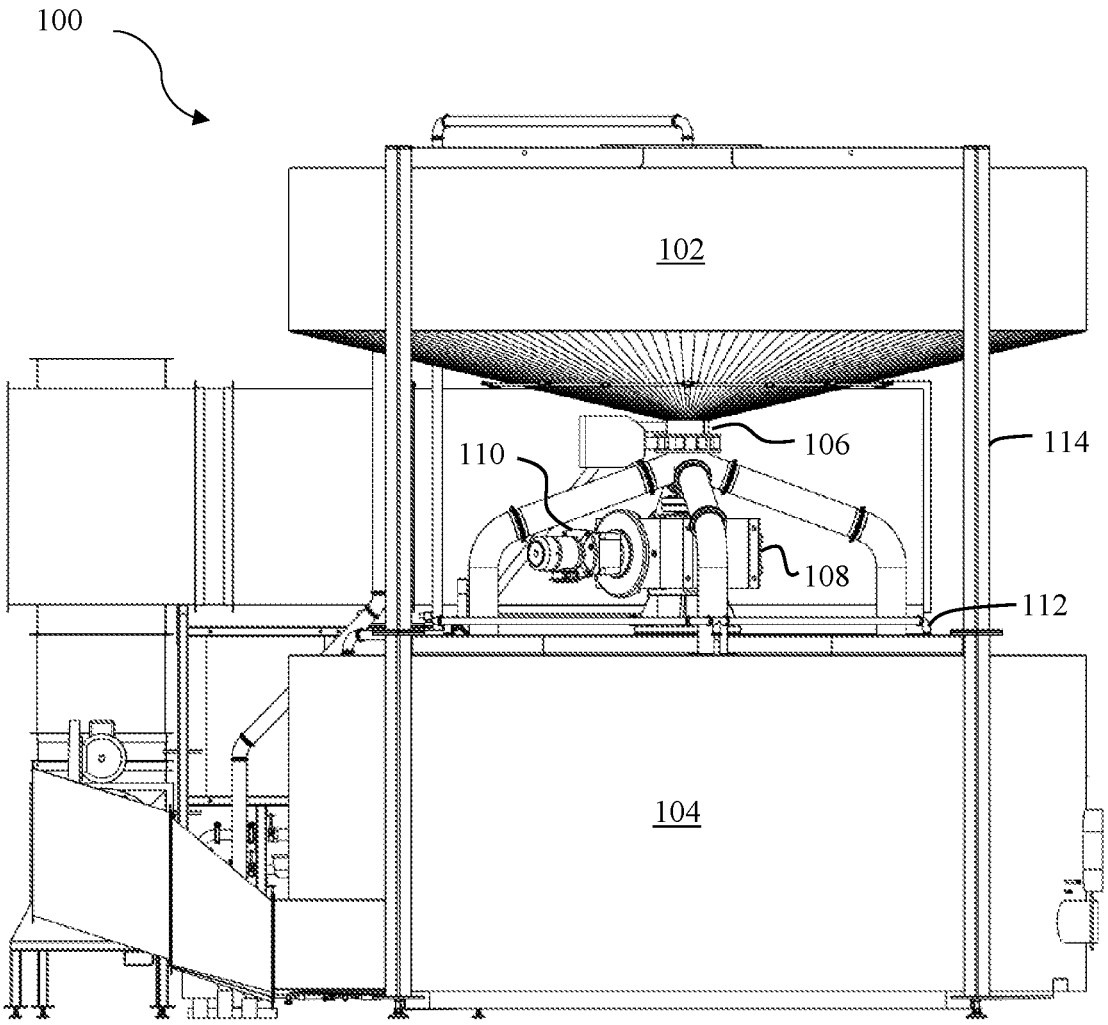
FIG. 1 illustrates a system in accordance with one embodiment.

FIG. 1 illustrates a system 100 that may be used for malting that may implement the agitator described herein. This malting system 100 may comprise two receptacles: an upper receptacle 102 and a lower receptacle 104 below the upper receptacle 102. The system 100 may further include a center shaft 106 that originates in the upper receptacle 102, extends through a gearbox 108 that is operably configured with a motor 110, and into the lower receptacle 104.

The gearbox 108 and motor 110 may be affixed between the upper receptacle 102 and the lower receptacle 104. For example, the gearbox 108 may sit between the receptacles 102 and 104 on top of horizontal pipes 112 that connect to vertical support pipes 114.

Figure 2:
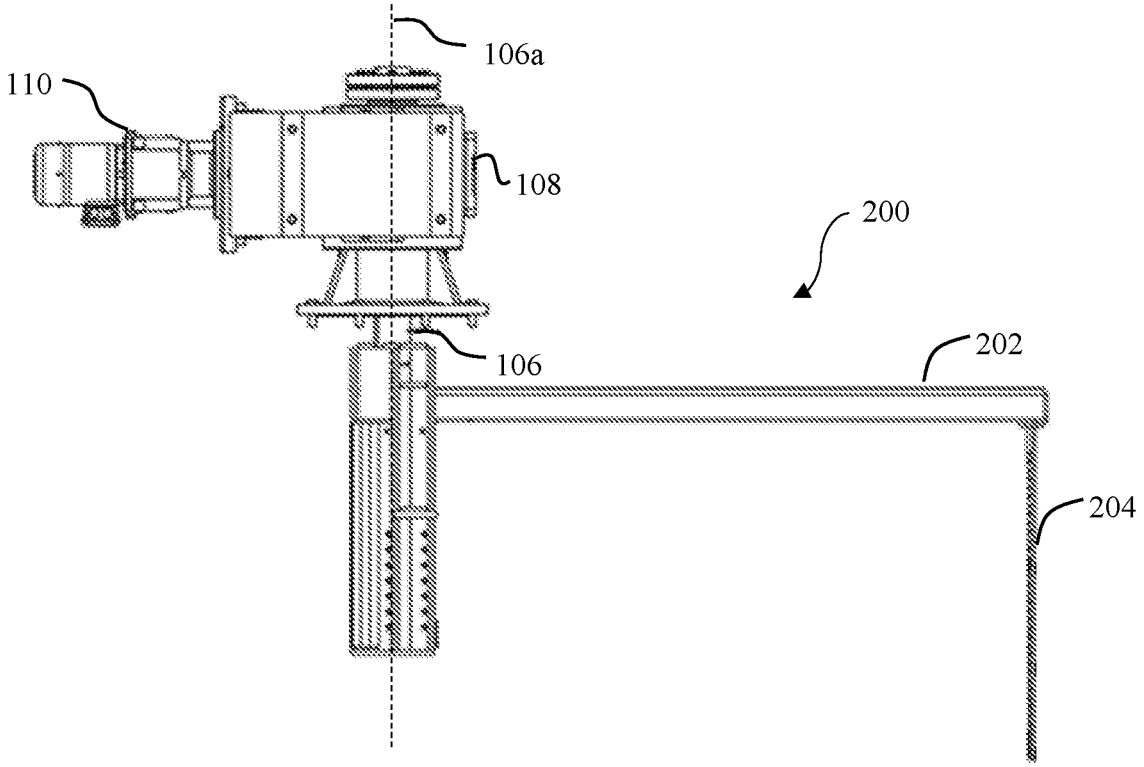
FIG. 2 illustrates an agitator in accordance with one embodiment.

The agitator in accordance with various embodiments may be positioned in the lower receptacle 104 to agitate material therein. FIG. 2 illustrates a side view of an agitator 200 in accordance with one embodiment. As seen in FIG. 2, the agitator 200 includes the shaft 106 (shown in FIG. 1), an arm 202 extending substantially orthogonally from the shaft 106, and a knife 204 hanging or otherwise extending substantially orthogonally from the arm 202.

In use, the gearbox 108 and motor 110 power the shaft 106 to rotate about its axis 106*a* in the lower receptacle 104. As the shaft 106 rotates, the arm 202 rotates around the shaft 106, thereby moving the knife 204 a circular motion through the material in the lower receptacle 104. This motion of the knife 204 therefore agitates the material in the lower receptacle 104.

Figure 3A:
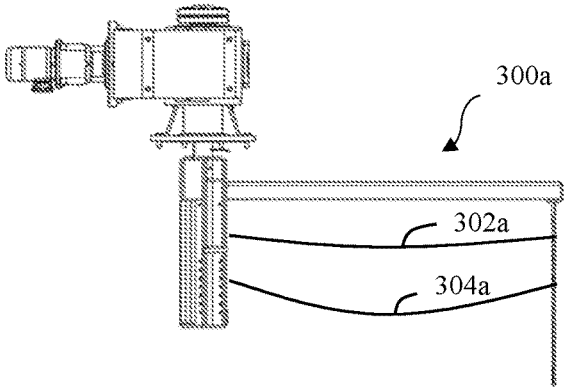
FIGS. 3A-D illustrate an agitator with agitator elements in accordance with various embodiments.

In some embodiments, the agitator may further include one or more agitator elements to provide additional agitation. For example, FIG. 3A illustrates an agitator 300*a* that may be similar to the agitator 200 of FIG. 2. However, in this embodiment, the agitator 300 includes agitator elements 302*a* and 304*a*. These agitator elements 302*a* and 304*a* (illustrated as wires/cables with different amounts of tension) provide additional agitation as they break up the planes of the material during operation.

Figure 3B:
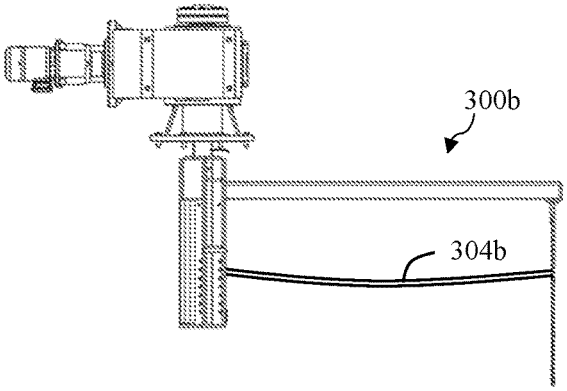
Figure 3C:
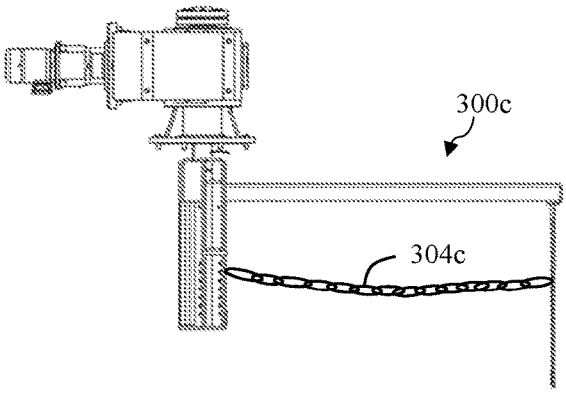
Figure 3D:
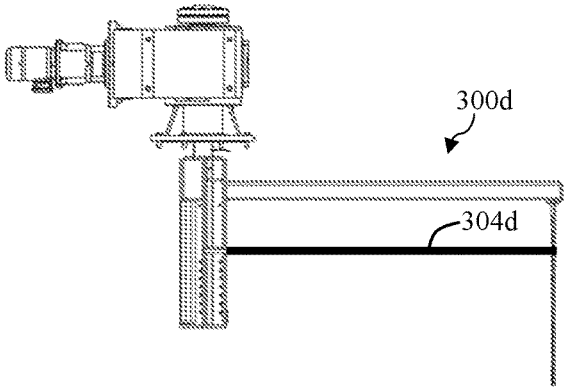

Although the agitator elements 302*a* and 304*a* are illustrated as wires, it is contemplated that other types of agitator elements may be used. For example, FIG. 3B illustrates an agitator 300*b* with an agitator element 304*b* configured as a cable (e.g., a stainless steel cable). As another example, FIG. 3C illustrates an agitator 300*c* with an agitator element 304*c* configured as a chain. As yet another example, FIG. 3D illustrates an agitator 300*d* with an agitator element 304*d* configured as a rigid material. The exact configuration of the agitator element(s) may vary as long as they can agitate material as desired.

Figure 4:
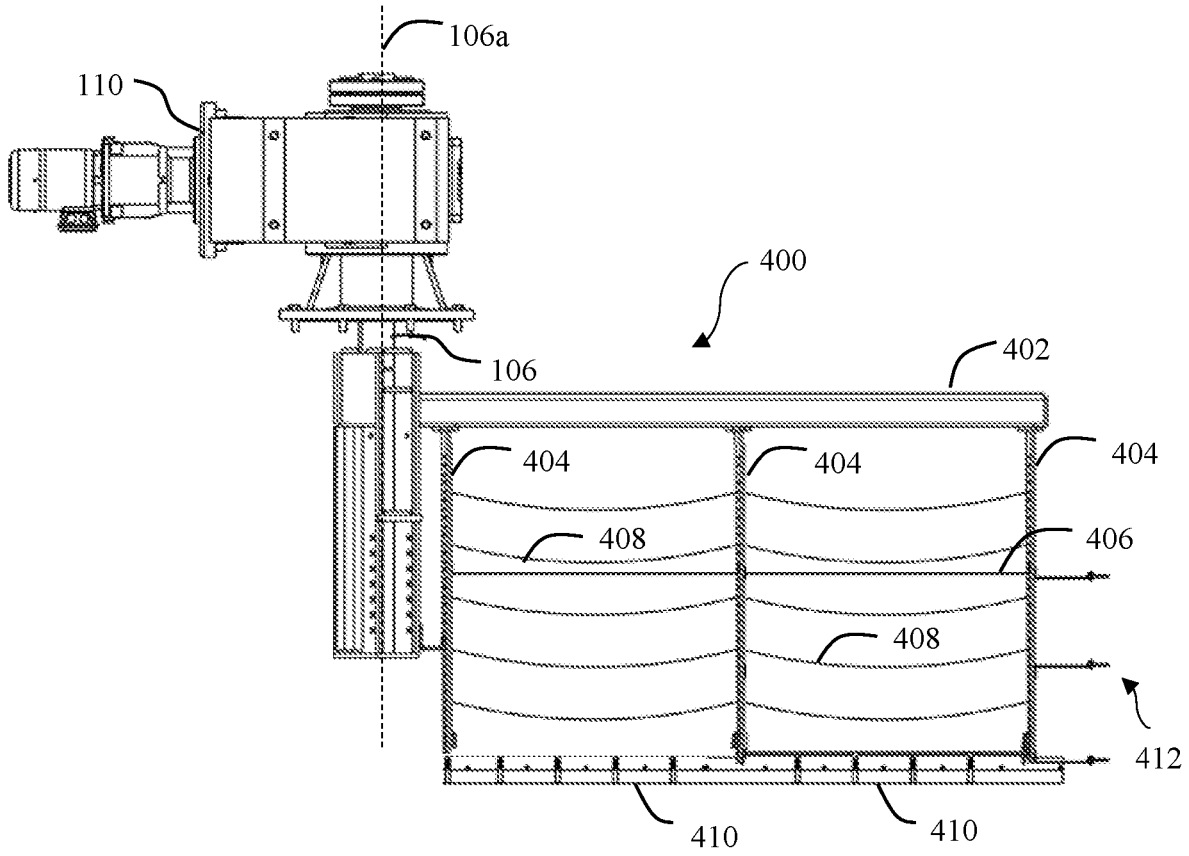
FIG. 4 illustrates an agitator in accordance with another embodiment.

FIG. 4 illustrates yet another embodiment of an agitator 400. In FIG. 4, the agitator 400 includes an arm 402 with multiple knives 404 extending substantially orthogonally therefrom. The agitator 400 of FIG. 4 may also include one or more horizontal supports 406 positioned between the knives 404. The agitator 404 also includes several agitator elements 408 (illustrated as wires) extending between the knives 404.

Figure 5:
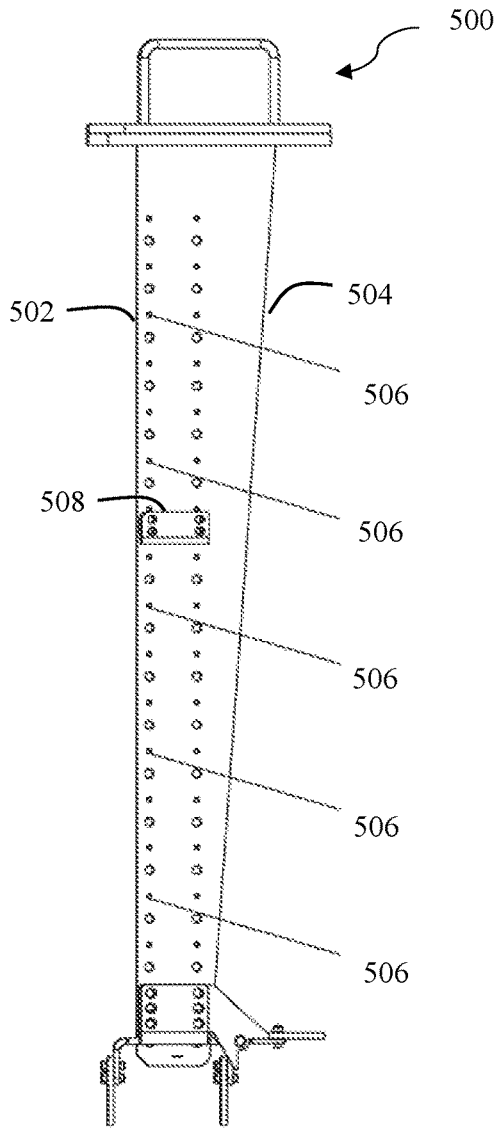
FIG. 5 illustrates the knife of FIGS. 2-4 in accordance with one embodiment.

FIG. 5 illustrates a knife 500 in accordance with one embodiment. The knife 500 may be similar to the knives shown in FIGS. 2-4. As seen in FIG. 5, the knife 500 includes a straight leading edge 502 and a tapered trailing edge 504. However, a device of any suitable shape may be used as long as it can agitate material as required and support any desired agitator element(s). The knife 500 may also include a plurality of apertures 506 configured to receive agitator elements such as wires, cables, etc. The apertures 506 may be spaced one inch apart, for example.

The knife 500 is also illustrated with a horizontal support 508 such as the horizontal support 406 of FIG. 4 secured thereon. The position of the horizontal support(s) 508 may of course vary by, e.g., securing them in different apertures 506 and may depend on the material in the lower receptacle 104.

As seen in FIGS. 2-4, the knife or knives may hang from or otherwise be affixed to the arm and extend substantially orthogonally from the arm at a downward angle (i.e., into the receptacle). The knives therefore serve two functions. First, the knives themselves function as agitators that break up the material as they pass through the material. Second, the knives may hold or otherwise support the agitator elements that pass through and agitate the material.

In some embodiments, the agitator may include at least two knives (as in FIG. 4). In other embodiments, the agitator may include only one knife (as in FIGS. 2 and 3A-D). It should be noted, however, that any number of knives may be used.

The agitator elements of various embodiments may be staggered and act as individual agitators that break up material such as grain. By staggering the agitator elements, the agitator avoids placing too much structure in one area. In this context, the term "structure" may refer to the planes that are created as the agitator elements pass through the material. Accordingly, it may be desirable to have agitator elements spaced apart from each other, as well as to have different amounts of tension on each individual agitator element.

For example, the wires 302*a* and 304*a* of FIG. 3 have different amounts of tension. Wire 304*a* has less tension than wire 302*a*, and is illustrated as "sagging." These wires or other types of agitator elements may be strung through the apertures 506 of the knife or knives and fixed (e.g., knotted) to the knives to stay in place. In some embodiments, the agitator element(s) may be affixed to a knife or knives using a clamping device. The technique used to secure the agitator element(s) to the knives, as well as the shaft, may of course vary as long as the features of the various embodiments described herein may be accomplished.

An operator is therefore able to change the spacing and also the tension of each agitator element based on the specific needs of, for example, the material to be agitated. This allows the agitator of various embodiments to be tailored to meet the specific requirements of a given operation.

This allows a malting facility (or any other type of facility) to use less power while still providing the desired agitation. Accordingly, this extends the life of the motor 110, extends the life of the agitator, and reduces the energy expended as well as operational costs.

Referring back to FIG. 4, the agitator 400 may also include one or more bottom rakes 410. The bottom rakes 410 pass along the floor of the lower receptacle 104 to prevent material from matting along the floor.

Figure 6:
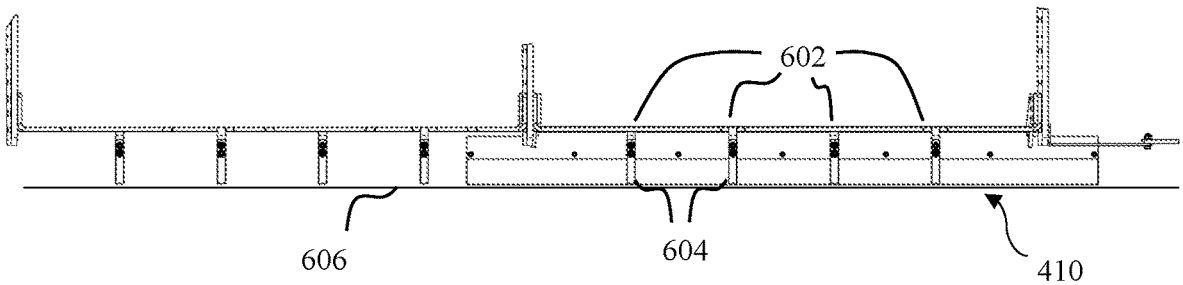
FIG. 6 illustrates the bottom rake of FIG. 4 in accordance with one embodiment.

FIG. 6 illustrates the bottom rake 410 of FIG. 4 in more detail. The bottom rakes 410 may include a plurality of staggered finger portions 602. These finger portions 602 may be made out of stainless steel, for example.

Each finger portion 602 may further include a silicone pad 604 secured thereon. The silicone pads 604 protect the floor 606 of the lower receptacle 104 and may compensate for tolerances in receptacle height and any non-flat portions of the receptacle floor 606.

Referring back to FIG. 4, the agitator 400 may also include one or more side rakes 412. The side rakes 412 may be in contact with or otherwise close to the side interior of the lower receptacle 104 to prevent material from matting thereon.

Figure 7:
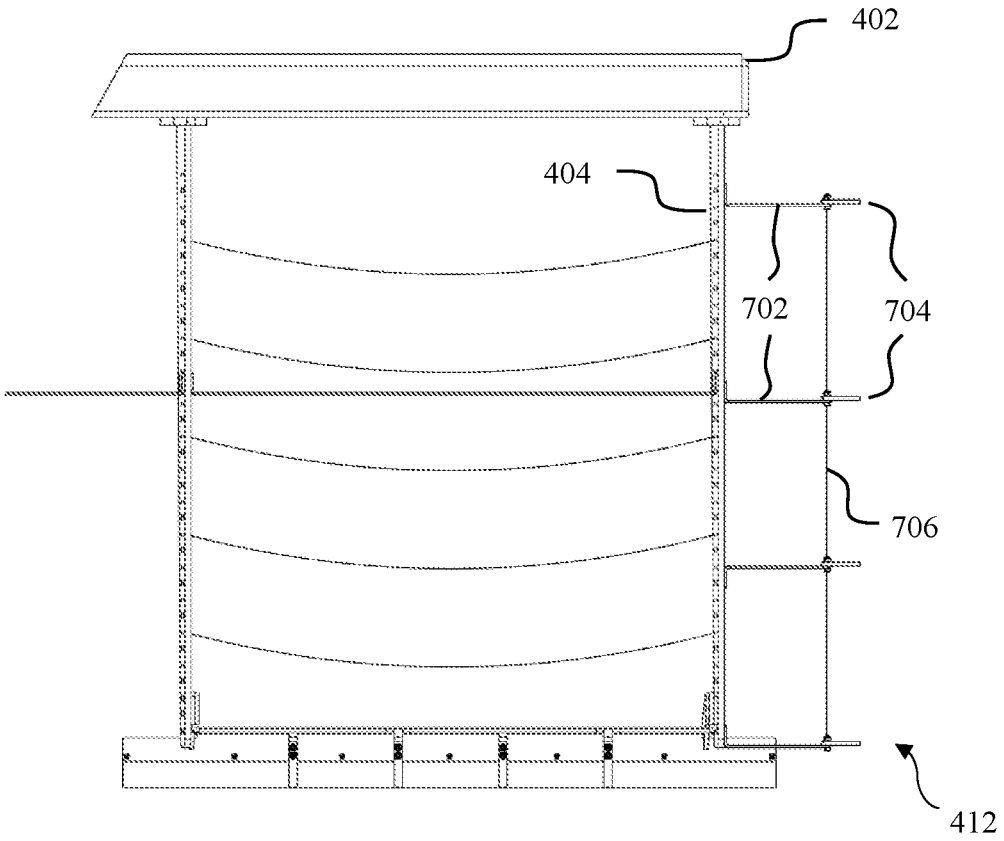
FIG. 7 illustrates the side rake of FIG. 4 in accordance with one embodiment.

FIG. 7 illustrates the side rake 412 of FIG. 4 in more detail. The side rake 412 may include a distal knife 404 extending vertically downward from the arm 402. The side rake 412 may include multiple brackets 702 attached to the distal knife 404. The brackets 702 may be secured to one or more of the apertures in the knife 404.

Similar to the bottom rake 410, each bracket 702 may include a silicone pad 704 secured thereon. The elasticity of the silicone pads 704 may compensate for tolerances or discrepancies in receptacle diameter and acts to prevent any material from matting on the receptacle side.

In addition to the silicone pads 704, the side rake 412 may also include a wire 706 (or other type of agitator element) that is run vertically through each layer of the side rake 412. This wire 706 provides an additional agitation tool that prevents material from matting or otherwise accumulating on the side of the receptacle. With this wire 706, the side rake 412 in accordance with these embodiments extends out to the edge of the receptacle 104 as far as possible while maintaining as little load as possible.

The above discussions regarding the configuration of the agitator and the components thereof are merely exemplary. For example, the bottom rake 410 and/or the side rake 412 of FIG. 4 may be configured with the agitators of FIGS. 2 and 3A-D. It is contemplated that the agitator may be configured in a variety of additional ways as well.

Figure 8:
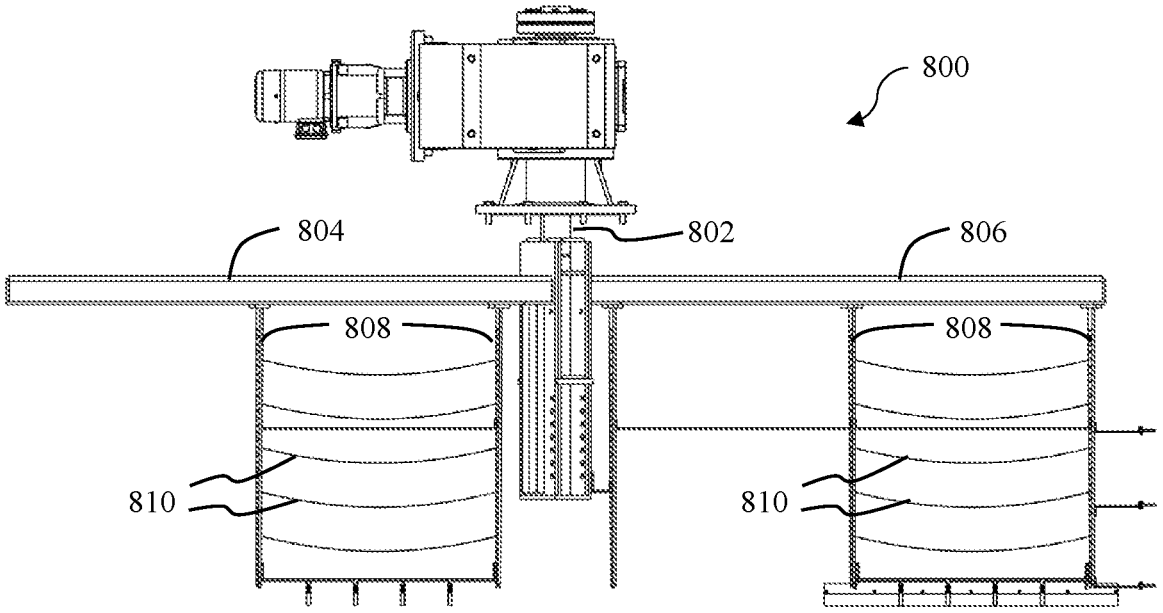
FIG. 8 illustrates an agitator in accordance with another embodiment.

For example, FIG. 8 illustrates an agitator 800 in accordance with another embodiment. In this embodiment, the agitator 800 includes a shaft 802, a first arm 804 extending from the shaft 802, and a second arm 806 extending from the shaft 802. Arms 804 and 806 may each include one or more knives 808 with agitator elements 810 that are strategically placed to agitate material.

Arm 804 may include agitator elements 810 placed between a proximal knife (closest to the shaft 802) and a middle knife, and arm 806 may include agitator elements 810 placed between a middle knife and a distal knife (placed away from the shaft 802). Using two arms such as in FIG. 8 reduces the bending load on the gear box bearings as the arms more equally counterbalance the bending loads.

Figure 9:
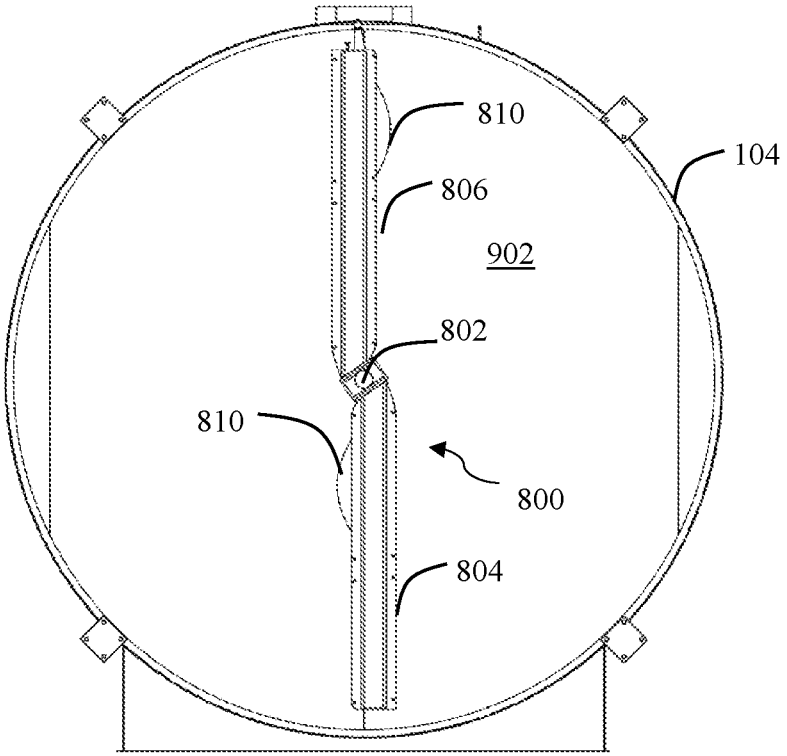
FIG. 9 illustrates a top view of the agitator of FIG. 8 in accordance with another embodiment.

FIG. 9 illustrates a top view of the agitator 800 of FIG. 8 operably positioned within the lower receptacle 104. As can be seen from this top view, the agitator elements 810 are operably positioned with respect to the arms 804 and 806. As the arms 804 and 806 rotate about the shaft 802, the agitator elements 810 pass through or otherwise agitate the material 902 within the lower receptacle 104.

Figure 10:
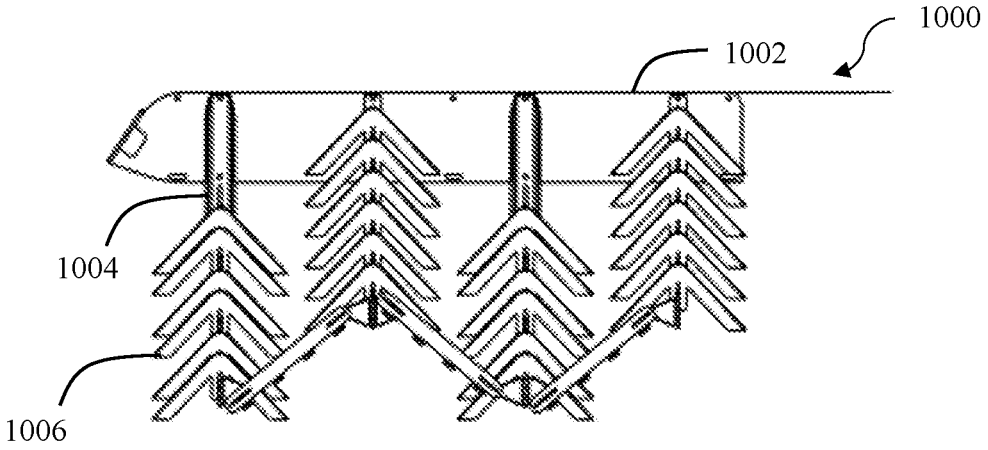
FIG. 10 illustrates an agitator with delta blades in accordance with one embodiment.

FIG. 10 illustrates an agitator 1000 in accordance with another embodiment. In this embodiment, an arm 1002 may include a plurality of knives 1004, and the agitator elements may be configured as delta blades 1006. The number and/or placement of the delta blades 1006 may vary as well as long as the knives 1004 and the delta blades 1006 may agitate the material as required.

Figure 11:
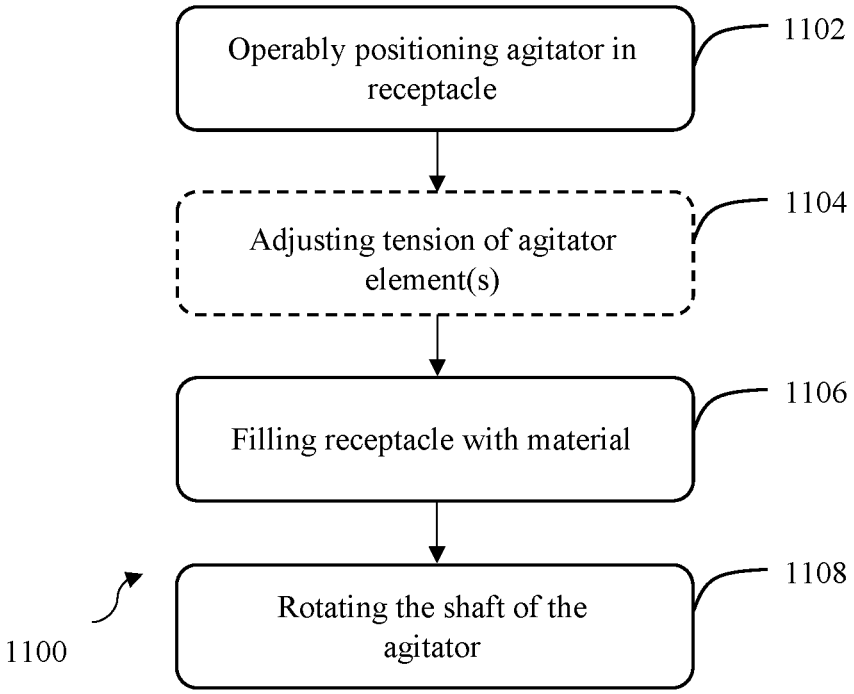
FIG. 11 depicts a flowchart of a method of agitating receptacle content in accordance with one embodiment.

FIG. 11 depicts a flowchart of a method 1100 of agitating receptacle content in accordance with one embodiment. This method 1100 may be performed using an agitator such as the agitators of FIGS. 2-4, 8, and 10. As described above, these agitators may include a shaft, at least one arm, and at least one knife extending from the arm(s). In some embodiments, the agitator may also include at least one agitator element extending between the shaft and a knife, between two knives, etc.

Step 1102 involves operably positioning the agitator in a receptacle. The receptacle may be any receptacle used to hold material for processing, such as the lower receptacle 104 of FIG. 1.

Step 1104 is optional and involves adjusting the tension of at least one agitator element. If one or more agitator elements are included as part of the agitator such as in FIGS. 3 and 4, an operator may adjust the tension (and/or placement) of the agitator elements based on specific operational requirements.

Step 1106 involves filling the receptacle with a material. In some embodiments, this may be a granular material used in a malting process.

Step 1108 involves rotating the shaft of the agitator. The shaft may be rotated by a movement mechanism such as the gearbox 108 and motor 110 of FIG. 1, for example. As the shaft rotates, the arm, knife or knives, as well as any agitator elements may pass through and therefore agitate the material in the receptacle.

The methods, systems, and devices discussed above are examples. Various configurations may omit, substitute, or add various procedures or components as appropriate. For instance, in alternative configurations, the methods may be performed in an order different from that described, and that various steps may be added, omitted, or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Embodiments of the present disclosure, for example, are described above with reference to block diagrams and/or operational illustrations of methods, systems, and computer program products according to embodiments of the present disclosure. The functions/acts noted in the blocks may occur out of the order as shown in any flowchart. For example, two blocks shown in succession may in fact be executed substantially concurrent or the blocks may sometimes be executed in the reverse order, depending upon the functionality/acts involved. Additionally, or alternatively, not all of the blocks shown in any flowchart need to be performed and/or executed. For example, if a given flowchart has five blocks containing functions/acts, it may be the case that only three of the five blocks are performed and/or executed. In this example, any of the three of the five blocks may be performed and/or executed.

A statement that a value exceeds (or is more than) a first threshold value is equivalent to a statement that the value meets or exceeds a second threshold value that is slightly greater than the first threshold value, e.g., the second threshold value being one value higher than the first threshold value in the resolution of a relevant system. A statement that a value is less than (or is within) a first threshold value is equivalent to a statement that the value is less than or equal to a second threshold value that is slightly lower than the first threshold value, e.g., the second threshold value being one value lower than the first threshold value in the resolution of the relevant system.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of various implementations or techniques of the present disclosure. Also, a number of steps may be undertaken before, during, or after the above elements are considered.

Having been provided with the description and illustration of the present application, one skilled in the art may envision variations, modifications, and alternate embodiments falling within the general inventive concept discussed in this application that do not depart from the scope of the following claims.

What is claimed is:

1. An agitator, the agitator comprising:

a shaft;

an arm extending substantially orthogonally from the shaft;

at least two knives per arm extending substantially orthogonally from the arm; and at least one horizontal agitator element extending between the at least two knives and parallel to the arm, the horizontal agitator element comprising at least one of a chain, a wire, a cable, and a rod, wherein:

the at least two knives are separate components and extend from the arm in the same direction as each other; and each of the at least two knives has at least one tapered edge.

2. The agitator of claim 1 wherein the at least one horizontal agitator element is configured to maintain a set tension during rotation of the agitator and the length of the horizontal agitator element is adjustable before the rotation of the agitator.

3. The agitator of claim 2 wherein each of the two knives include a plurality of apertures configured to receive the at least one agitator element.

4. The agitator of claim 3 further comprising at least one horizontal support placed between the two knives and attached to each knife via at least one of the plurality of apertures.

5. The agitator of claim 2 wherein the placement of the at least one horizontal agitator element on at least one of the knives is adjustable.

6. The agitator of claim 2 wherein the tension on each of the at least one horizontal agitator element is individually adjustable.

7. The agitator of claim 1 wherein the horizontal agitator element is not the rod.

8. The agitator of claim 1 further comprising a movement mechanism rotatably coupled to the shaft.

9. The agitator of claim 8 wherein at least one of the knives is affixed to the arm.

10. The agitator of claim 1 wherein the arm includes a proximal end and a distal end, the distal end having an additional knife hanging therefrom that has at least one side rake secured thereon.

11. The agitator of claim 10 wherein the side rake includes at least one of a vertical hanging wire and at least one flexible pad.

12. The agitator of claim 1 further comprising a bottom rake horizontally attached to the at least two knives at a position below both the at least one horizontal agitator element and the arm and not in contact with the arm.

13. The agitator of claim 12 wherein the bottom rake includes:

at least one rigid pad; and at least one flexible pad.

14. The agitator of claim 1 operably positioned in a receptacle.

15. The agitator of claim 1 further comprising:

at least a second arm extending substantially orthogonally from the shaft, and at least one knife extending substantially orthogonally from the second arm.

16. The agitator of claim 1 further comprising at least one delta blade affixed to at least one knife of the at least two knives.

17. The agitator of claim 1 further comprising a chain extending from a first knife to a second knife or from the first knife to the shaft.

18. The agitator of claim 1 further comprising a cable extending from a first knife to a second knife or from a first knife to the shaft.

19. The agitator of claim 1 further comprising a wire extending from a first knife to a second knife or from a first knife to the shaft.

20. A method of agitating receptacle content, the method comprising:

operably positioning the agitator of claim 1 in a receptacle;

filling the receptacle with a granular material; and rotating the shaft of the agitator of claim 1.

21. The method of claim 20 further comprising adjusting a tension on the at least one agitator element.

22. An agitator, the agitator comprising:

a vertical shaft;

an arm extending substantially horizontally from the vertical shaft;

at least one knife, the at least one knife having a length, a width, and a thickness, the length exceeding the width and the width exceeding the thickness, the at least one knife oriented so that the length extends substantially orthogonally from the arm and parallel to the vertical shaft; and at least one horizontal agitator element extending from the at least one knife parallel to the arm and operably connected to the vertical shaft, the horizontal agitator element comprising at least one of a chain, a wire, a cable, and a rod.

* * * * *